United States Patent [19]

Carbonnel

[11] 4,161,647

[45] Jul. 17, 1979

[54] ELECTRICALLY HEATED SPIGOT FOR CONNECTING AN ELECTROMAGNETIC SUPPLYING PUMP TO THE INLET OF A LOW PRESSURE CASTING MOULD

[76] Inventor: Henri Carbonnel, 11 avenue Beausejour, 92160 Antony, France

[21] Appl. No.: 856,770

[22] Filed: Nov. 29, 1977

[51] Int. Cl.[2] ..... F24H 1/18

[52] U.S. Cl. ..... 219/301; 219/300; 219/421; 219/424; 219/535; 13/31 R; 137/341; 138/33; 222/146 HE; 285/41

[58] Field of Search ..... 219/300, 301, 328, 421, 219/424, 425, 530, 523, 534, 535, 550; 285/8, 41, 47, 363, 405; 138/33, 149; 251/129, 130; 137/317, 341; 13/30; 222/146 HE

[56] References Cited

U.S. PATENT DOCUMENTS

| | | | |
|---|---|---|---|
| 3,213,177 | 10/1965 | Diefendorf | 13/31 |
| 3,371,186 | 2/1968 | Trabilcy | 219/300 |
| 3,423,570 | 1/1969 | Trabilcy | 219/301 |
| 3,726,305 | 4/1973 | Erickson et al. | 137/341 |
| 3,971,416 | 7/1976 | Johnson | 138/33 |
| 4,016,403 | 4/1977 | Best | 219/550 |

*Primary Examiner*—Volodymyr Y. Mayewsky
*Attorney, Agent, or Firm*—Haseltine, Lake & Waters

[57] ABSTRACT

A spigot for connecting the inlet of a low pressure casting mould to a pipeline connected to an electromagnetic pump for supplying the mould with liquid metal, the spigot being adapted to be clamped against the mould inlet, comprises a supply conduit surrounded by thermally insulating means within an external metal jacket, said conduit including a sleeve at that end to be connected to the mould inlet which is removable from the spigot in the event that metal solidifies in the sleeve, the sleeve being made of thermally insulating refractory material and being held in place, in use, by clamping the spigot to the mould inlet.

12 Claims, 3 Drawing Figures

ELECTRICALLY HEATED SPIGOT FOR CONNECTING AN ELECTROMAGNETIC SUPPLYING PUMP TO THE INLET OF A LOW PRESSURE CASTING MOULD

The invention relates to a spigot for connecting a pipeline connected to an electromagnetic pump for supplying molten metal to the inlet of a low-pressure casting mould.

A known installation for low-pressure casting comprises a crucible or holding bath containing the molten metal to be cast, an electromagnetic pump fixed to said crucible and immersed in said molten metal, a mould situated at a higher level than the crucible and laterally offset with respect thereto, and a pipeline connecting the pump outlet to the mould inlet, the pipeline having a slightly ascending rectilinear part, connected to the pump outlet, followed successively by a bend and an ascending vertical part leading to the inlet of the mould. The invention relates more specifically to the end portion of this pipeline.

According to the invention there is provided a spigot for connecting the inlet of a low pressure casting mould to a pipeline connected to an electromagnetic pump for supplying the mould with molten metal, said spigot being adapted to be clamped by clamping means against the inlet to the mould, said spigot comprising:

an inner refractory supply conduit;

an external metal jacket surrounding said conduit; and thermally insulating means surrounding said conduit and thermally separating said conduit from said jacket;

wherein that end of said conduit for connection to the mould inlet includes a removable sleeve of thermally insulating refractory material resistant to the corrosive action of the molten metal and provided, at its inner end, with a first gasket through which said sleeve bears on a part of said conduit and, at its outer end, with a second gasket through which, in use, the mould inlet will bear on said sleeve, said sleeve being held in place in said spigot by the effect of the clamping means which in use clamp said spigot to said mould inlet.

Said supply conduit preferably comprises two parts of unequal length, one of said parts for connection to the pipeline being bent and the second of said parts including said sleeve.

Said first part is preferably made of a thermally conductive ceramic.

Said external jacket may have flanges at both ends, the bottom flange being adapted to be connected to the ascending part of the jacket protecting the pipeline connected to the electromagnetic pump. The top flange is used to clamp said spigot, and specifically said removable sleeve, to the mould inlet. The clamping means provides sealing-tightness between the frusto-conical part forming the mould inlet and known as a goose-neck and said removable sleeve, by compressing said gasket disposed between the inlet and said sleeve.

Advantageously heating means is provided for heating said conduit.

In normal operation, when the pump is in operation, the level of molten metal is kept at the height of the bent first part of the conduit of the above described spigot. When a casting is to be made, the voltage applied to the pump is increased. Because of the characteristics of these pumps, the metal rises fairly quickly at first, and then more slowly into the mould, and the pressure continues to increase to a value corresponding to zero flow. Since the metal no longer flows in the conduit, the inlet of the mould, which is cooled in known manner by a water or air flow, will start to cause the metal to solidify. When the pressure applied to the pump has been restored to its original value, the metal still in the molten state in the removable sleeve will drop back towards the pump so that the level of molten metal is restored to its original position in the bent first part of the conduit.

The metal which started to solidify in the mould inlet completely sets and forms the dead head. The top half of the mould is withdrawn and the casting is removed. It will be seen that the removable sleeve provides two substantially simultaneous and conflicting functions in normal operation. First of all, it enables the bent first part of the conduit, which is heated, to be thermally isolated from the mould inlet which is cooled and in which the dead head will form. Secondly, since the sleeve is made of insulating material it does not cool the molten metal that it contains so that the metal will not set and the dead head remains localized at the level of the mould inlet.

Although such a balance may at least appear to be contradictory it is the result of a control system.

Nevertheless, an incident may occur which may instantaneously affect this control system and result, for example, in cooling of the metal for casting. In that case, the metal may solidify not only in the cooled frusto-conical inlet, but also in the removable sleeve. Such an incident is relatively rare because the sleeve itself is heated. However, even in such a case, the consequences of the incident are reduced to a minimum, i.e., a short-duration shutdown of the installation. All that needs to be done, in fact, is to disconnect and remove the spigot from the mould, the sleeve being left behind. This gives direct access to the sleeve which is broken and the casting thus released. The removable sleeve is replaced by a new sleeve and casting can be resumed without difficulty.

Such an incident, which in the known installation results in blocking of the base of the mould and of the molten metal supply conduit, in an installation using a conduit according to the present invention can result in operation being stopped for only a few minutes.

The above described connecting spigot may be used to connect the mould inlet to the pipeline connected to the electromagnetic pump irrespective of the orientation of the pipeline and irrespective of the position of the mould inlet.

The above described spigot is also particularly advantageous in any casting installation in which the connecting pipeline ascends, i.e., any installation in which supply is to the bottom part of the mould. Such supply may then be made either via a central inlet in the bottom of the mould, or via multiple inlets in the bottom of the mould, or laterally of the base of the mould. In the latter case, the or each inlet conduit is vertical and then inclined with respect to the horizontal to facilitate release from the mould.

The invention will be more fully understood from the following description of embodiments thereof, given by way of example only, with reference to the accompanying drawings.

In the drawings:

FIG. 1 shows an embodiment of a connecting spigot 1 connecting a pipeline (not shown), connected to an electromagnetic pump, to the inlet of a low-pressure casting mould 2.

Figure 1:
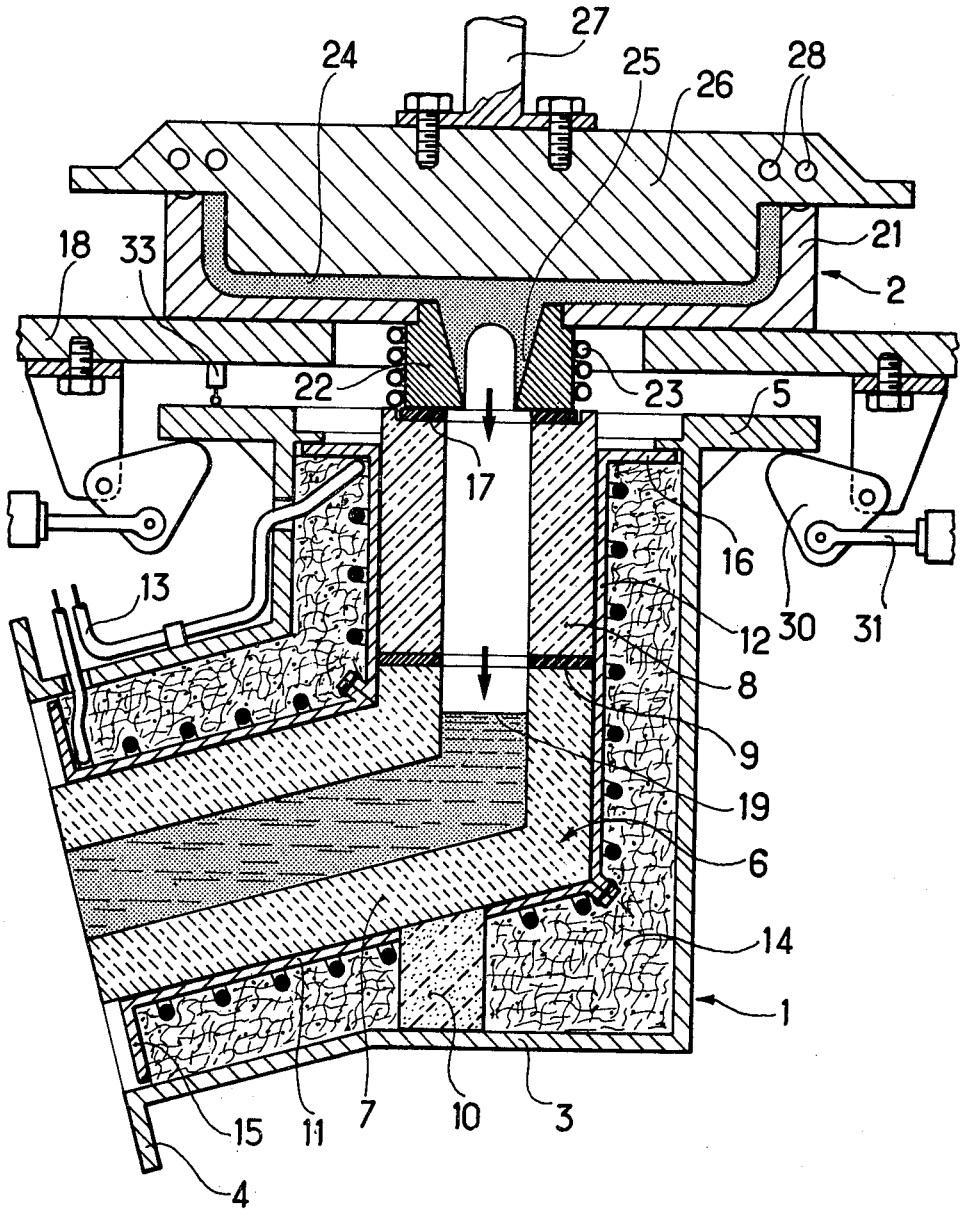
FIG. 1 is a vertical section through an embodiment of a spigot feeding a mould from below.

The connecting spigot comprises a metal jacket 3 (e.g. of steel) surrounding a supply conduit, the jacket 3 terminating at its lower end in a flange 4 for connection to the pipeline and, at its upper end, in a rigid thick flange 5.

The supply conduit 6 is in two parts, a lower bent part 7 made of a thermally conductive ceramic, e.g. a ceramic formed from a mixture of powder and particles of a carbide of a metal of group IV, and a removable upper part in the form of a sleeve 8 made of insulating refractory material, e.g. an insulating ceramic made from ceramic fibres dispersed in a refractory cement. These two parts are connected by a gasket 9. The conduit is made from materials which are resistant to the violently corrosive action of molten metals. It is common knowledge that there are thermally conductive ceramics and thermally insulating ceramics which withstand the corrosive action of molten metals, such as aluminium. In this case the gasket 9 and the other gaskets used will be made, for example, from an alumina felt.

The supply conduit 6 is supported and held in place in the outer metal jacket 3 by an insulating ceramic block 10.

The supply conduit 6 is also enclosed in a metal jacket made of stainless steel and formed from two connected cylinders 11 and 12. This metal jacket carries a variable heater winding 13, made preferably from Pyrotenax or any other conductor capable of withstanding high temperatures without insulation loss. The gap between the stainless steel jacket cylinders 11 and 12 and the outer jacket 3 is filled with a filling 14 of alumina fibres providing very considerable thermal insulation. This fibre filling is protected at the two ends by flanges 15 and 16 of the stainless steel jacket cylinders 11, 12. A gasket 17 is provided at the upper end of the removable sleeve 8.

The mould 2 is supported on a non-deformable and thick metal baseplate 18. This baseplate supports the bottom half 21 of the mould, which continues at its base in a frusto-conical inlet 22 cooled by an air cooling means 23. The stippling in FIG. 1 shows the casting 24 in the mould with its dead head 25. The top half of the mould 26 can be lifted by means 27 and is generally cooled by water flowing in ducts 28.

The connecting spigot is held in position in known manner by means of eccentric cams 30 each urged by a jack 31 which lifts the thick flange 5 to apply the removable sleeve 8 with predetermined force against the lower end of the frusto-conical part 22 through the agency of the gasket 17, which is compressed.

The air cooling means 23 may comprise a perforated pipe wound around the frusto-conical part 22 so that air streams provide vigorous cooling of the frusto-conical part 22. Consequently, during normal operation only the top part of the metal contained in the frusto-conical part will solidify when the flow of molten metal ceases. The pressure drop produced by means of the electromagnetic pump moves the non-solidified metal downwards, giving the dead head 25 its characteristic shape, and restores the level 19 of the metal in the bent part 7.

In the case of abnormal operation, in which the dead head accidentally extends into the molten metal supply conduit 6, contact between the detachable sleeve 8 and the frusto-conical mould inlet 22 is released by the action of the jacks 31. A limit indicator 33 causes the supply to the electromagnetic pump to be shut off and the molten metal drops back into the crucible. The connecting flange 4 can then be released from the pipeline and the connecting spigot can be turned on its vertical axis to release the sleeve 8 from the spigot, the sleeve 8 being connected to the frusto-conical part 22 by the solidified metal it contains which is connected to the casting. The sleeve 8 is broken and the casting can then be extracted or alternatively the continuation of the dead head can be sawn off at the level of the gasket 17 to release the casting. A new detachable sleeve 8 is fitted in the sleeve housing defined by the stainless steel jacket cylinder 12 and provided with a new gasket 17. Finally the spigot 1 is replaced and the installation is ready to operate again.

When the connecting flange 4 at the base of the connecting spigot is released from the pipeline, a second limit indicator (not shown) of the same type as the indicator 33 and connected in series with the latter breaks the supply circuit. This means that the pump can deliver molten metal into the pipeline only if the connecting flange 4 is clamped in position and the spigot has been applied against the mould inlet.

Figure 2:
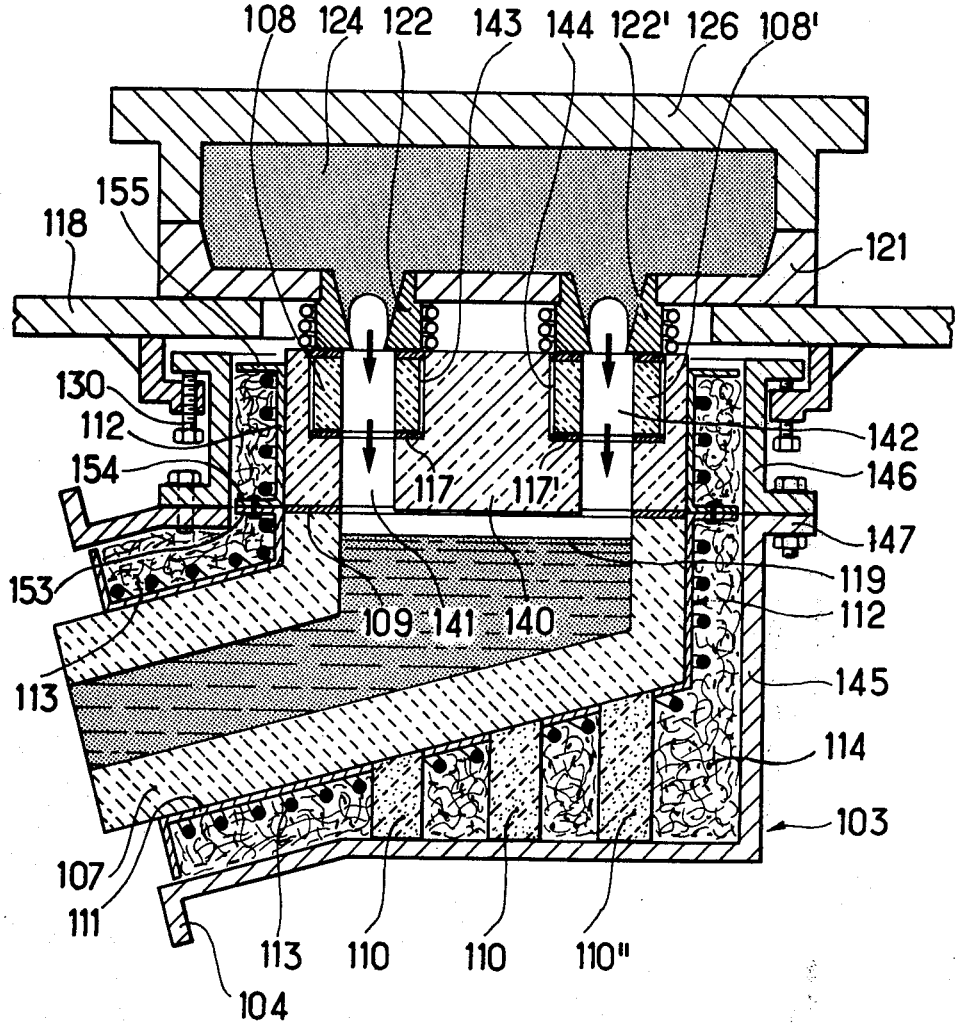
FIG. 2 is a vertical section through an embodiment of a spigot for supplying a mould with two inlets from below.

FIG. 2 shows another embodiment of a spigot which provides a double supply via the base of the mould. The spigot is similar to FIG. 1 in every respect and the same reference numbers have been used as are used in FIG. 1 but with the addition of 100 to each reference number. Consequently, the outer metal jacket becomes 103 instead of 3, the connecting flange 104 and so on.

The conductive ceramic supply conduit part 107 contains the level 119 of molten metal and in this embodiment its upper end has an elongate shape. The upper part of the conduit comprises, in this embodiment, a solid elongate-section cylindrical member 140 formed with two circular ducts 141 and 142 and made of a thermally insulating refractory material. The top part of each of the two ducts is widened to define two cylindrical chambers 143 and 144 containing two identical removable sleeves 108, 108' also made of insulating refractory material and each bearing on the member 140 through two alumina felt gaskets 117, 117'. The sleeves 108, 108' and member 140 are pressed against the two mould inlets 122 and 122' by an adjustable clamping means 130 known per se.

In the present embodiment it is advantageous to provide for disconnection of the conductive ceramic supply conduit part 107 and the insulating ceramic member 140. To this end, the outer jacket 103 is separated into two parts 145, 146 connected by clamping means 147. Similarly, the stainless steel inner jacket is in two separable parts, a first ascending part 111, similar to part 11 in FIG. 1, and a vertical part 112. Part 111 has a flange 153 at its upper end which bears against a flange 154 at the lower end of part 112. Part 112 also has a flange 155 at its upper end.

Disconnection is carried out in the plane of the gasket 109. The two removable sleeves 108 and 108' can then be removed more easily.

Figure 3:
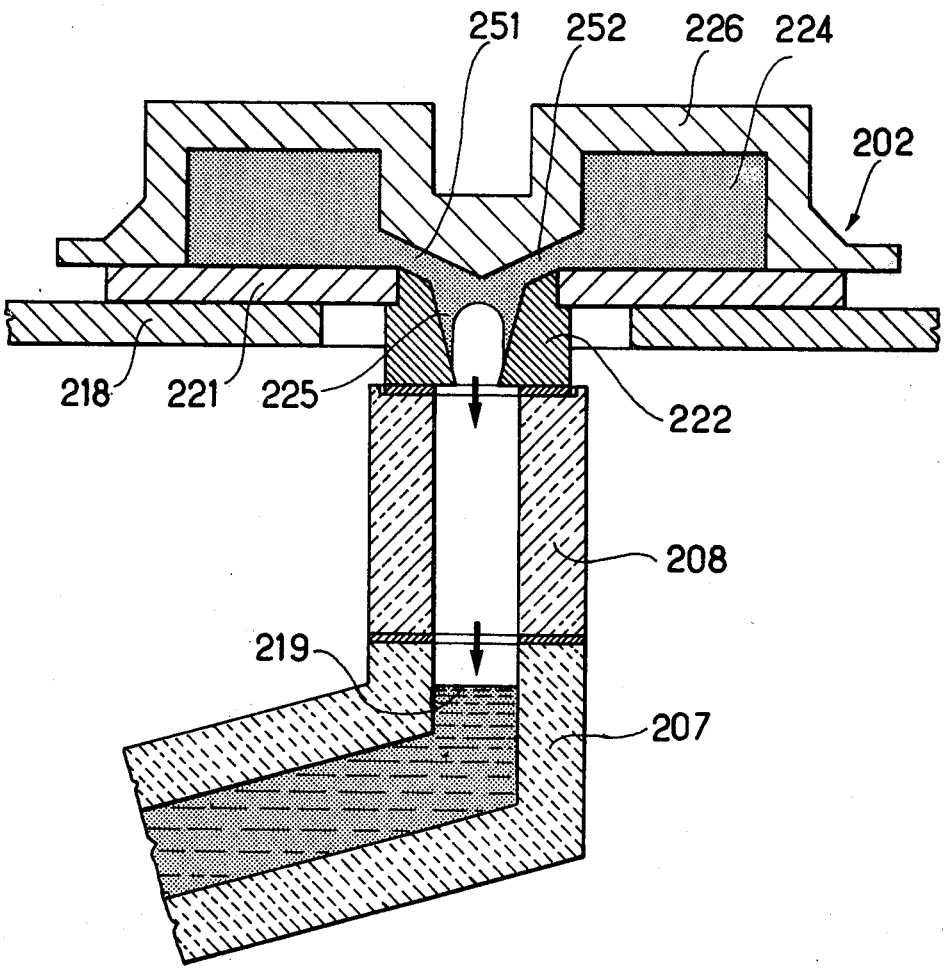
FIG. 3 is a vertical section through an embodiment of a spigot for feeding two moulds with inclined lateral inlets.

FIG. 3 is a simplified diagram showing a further embodiment of a spigot feeding a mould 202 by two inclined inlets 251 and 252 simultaneously, the arrangement resulting in the formation of a single dead head 225. As was previously the case, the mould is disposed on a table 218 and has a bottom part 221 and a detachable top part 226. The oblique inlets 251 and 252 are thin enough for the two parts of the casting 224 to be considered as two separate parts, although a single dead head is formed. The joint risk of solidification is reduced to the risk of solidification in the insulating part 208 of the molten metal supply spigot. Consequently, a detachable sleeve 208 similar to the sleeves described hereinbefore can protect, under the same conditions, either the simultaneous casting of two independent castings or the casting of a single casting through two inclined ducts feeding the same mould via its base. The present diagram shows the simultaneous feeding of two castings. A spigot could also be provided which feeds simultaneously three identical castings disposed symmetrically about the sleeve 208. A single dead head such as 225 is always obtained during the casting operation.

This shows the great advantage of using a detachable spigot as described above, since it allows either a single mould to be fed via a number of inlets, or a plurality of moulds to be fed, or a single mould to be fed, via a single vertical inlet.

What is claimed is:

1. A spigot for connecting the inlet of a low pressure casting mould to a pipeline connected to an electromagnetic pump for supplying the mould with molten metal, said spigot being adapted to be clamped by clamping means against the inlet to the mould, said spigot comprising: an inner refractory supply conduit; an external metal jacket surrounding said conduit; and thermally insulating means surrounding said conduit and thermally separating said conduit from said jacket; wherein that end of said conduit for connection to the mould inlet includes a removable sleeve of thermally insulating refractory material resistant to the corrosive action of the molten metal and provided, at its inner end, with a first gasket through which said sleeve bears on a part of said conduit and, at its outer end, with a second gasket through which, in use, the mould inlet will bear on said sleeve, said sleeve being held in place in said spigot by the effect of the clamping means which in use clamp said spigot to said mould inlet and a sleeve housing bounding said insulating refractory material adapted to enable release of said sleeve from said spigot.

2. A spigot according to claim 1, wherein said external metal jacket is provided with flanges at its ends.

3. A spigot according to claim 1, wherein said conduit comprises a first part for connection to the pipeline and a second part including said sleeve, said first part being made of a ceramic which is resistant to the corrosive action of the molten metal, which withstands repeated thermal shocks and which has a high thermal conductivity.

4. A spigot according to claim 1, wherein said thermally insulating means comprises a filling of alumina fibres and is bounded internally by a metal jacket surrounding said conduit.

5. A spigot according to claim 1, including a resistance heater for heating said conduit.

6. A spigot according to claim 4, including resistance heater means carried by said metal jacket for heating said conduit including said sleeve.

7. A spigot according to claim 1, wherein said first gasket is made of alumina felt.

8. A spigot according to claim 1, wherein said second gasket is made of alumina felt.

9. A spigot according to claim 3, wherein said conduit is held in place in said external jacket by an insulating ceramic block supporting said first part of said conduit.

10. A spigot according to claim 1, for use with a mould having two inlets, wherein said conduit comprises a first part for connection to the pipeline and a second part for connection to the mould inlets, said second part comprises a member made of a thermally insulating refractory material and provided with two ducts, one for each inlet, and a said removable sleeve is provided in respect of each duct, each said sleeve being housed in a cylindrical recess in said respective duct.

11. A spigot according to claim 10, wherein said first part of said conduit is bent and is supported in said external jacket by insulating ceramic members.

12. A spigot according to claim 10, wherein said spigot is separable into two parts along the junction between said first and second parts of said conduit.

* * * * *